United States Patent [19]

Seeney et al.

[11] Patent Number: 4,522,651

[45] Date of Patent: Jun. 11, 1985

[54] FOUNDRY MOLD AND CORE COMPOSITION

[75] Inventors: Charles E. Seeney, Brazil; John F. Kraemer, Terre Haute, both of Ind.

[73] Assignee: International Minerals & Chemical Corp., Terre Haute, Ind.

[21] Appl. No.: 342,313

[22] Filed: Jan. 25, 1982

[51] Int. Cl.[3] ..... B28B 7/34

[52] U.S. Cl. ..... 106/38.3; 106/38.9; 164/528

[58] Field of Search ..... 164/528; 423/314, 312; 106/38.3, 286.6, 286.7, 38.9

[56] References Cited

U.S. PATENT DOCUMENTS

| | | | |
|---|---|---|---|
| 3,044,851 | 7/1962 | Young | 423/312 |
| 3,316,106 | 4/1967 | Montague et al. | 106/58 |
| 3,333,925 | 8/1967 | Young | 423/314 |
| 3,441,374 | 4/1969 | Shen | 423/312 |
| 3,547,670 | 12/1970 | Fuchs et al. | 106/38.3 |
| 3,923,525 | 12/1975 | Toeniskoetter et al. | 106/38.3 |
| 4,126,665 | 11/1978 | Ropp | 423/314 |
| 4,162,300 | 7/1979 | Adrian et al. | 423/314 |

OTHER PUBLICATIONS

N. H. Ray, Inorganic Polymers, pp. 27-33, Academic Press, 1978.

*Primary Examiner*—Lorenzo B. Hayes
*Attorney, Agent, or Firm*—Robert H. Dewey

[57] ABSTRACT

A combination of foundry aggregate, binder and hardener for the foundry aggregate wherein a linear metal polyphosphate or ammonium polyphosphate is used as the binder, and the hardener is phosphoric acid or a mixture of phosphoric acid and a source of polyvalent metal cations.

10 Claims, No Drawings

FOUNDRY MOLD AND CORE COMPOSITION

This invention relates to an improved process for preparing foundry cores and molds using a foundry aggregate and a binder therefor. In a particular aspect this invention relates to an improved binder for the aggregate.

Binders for foundry aggregates used for making foundry cores and molds for metal castings are usually organic in nature, i.e. organic polymers and resins. These organic compounds are decomposed or volatilized when the molten metal contacts the core or mold and the resulting fumes and vapors cause a problem of air pollution. There is, therefore, a need to provide an all inorganic, non-volatile binder which is non-contaminating to the environment.

It is known that ammonium and metal dihydrogen phosphates lose water when heated and form linear polyphosphates of high molecular weight. Ammonium, sodium and potassium polyphosphates are generally soluble in aqueous ionic media, such as in a solution of a different alkali cation. For example, potassium polyphosphate can be dissolved by placing it in a solution of a lithium salt until it swells to form a gel. The gel can then be dissolved in water. Potassium polyphosphate also dissolves in hydrogen peroxide.

SUMMARY OF THE INVENTION

It is an object of this invention to provide an improved process for preparing foundry molds and cores using a foundry aggregate and a binder therefor.

It is another object of this invention to provide an improved inorganic binder for foundry aggregate.

Other objects of this invention will be apparent to those skilled in the art from the disclosure herein.

It is the discovery of this invention to provide an improved process for preparing foundry cores and molds using a foundry aggregate and an inorganic binder therefor. The improvement is provided by using as the binder a linear metal polyphosphate, or ammonium polyphosphate and phosphoric acid as a hardener therefor. A source of polyvalent metal cations can also be included as a component of the hardener.

DETAILED DISCUSSION

The order of mixing the ingredients in the practice of this invention is not critical. Generally, however, it is preferred to mix the comminuted dry ingredients first, then add the liquids. It is believed that this method best ensures thorough mixing, free from lumps and localized concentrations of one or more ingredients. The dry ingredients may include the aggregate, the polyphosphate and the source of polyvalent metal cations. If desired, however, the polyphosphate can be dispersed in an aqueous medium and added along with phosphoric acid as the liquid portion. The polyphosphate is used in an amount of about 1–10% based on the weiqht of the aggregate. Potassium and ammonium polyphosphates can, for example, be dispersed in an aqueous ionic solution such as ammonium, lithium, or sodium salts of about 10% by weight concentration. They can also be dispersed in 10% by weight hydrogen peroxide and ammonium polyphosphate can be dispersed in water. The mixture with sand is very viscous and must be well processed to insure thorough mixing.

After coating the aggregate with the linear polyphosphate, there is added orthophosphoric acid 1–10% based on the aggregate as a hardener. In a preferred embodiment, there is also added as a component of the hardener a source of polyvalent cations 1–10%. The polyvalent cation can be provided by black or green wet process phosphoric acid, as described below.

The mixture of aggregate and binder is now delivered to the mold or core box where it is permitted to cure for 2 hours or until a compressive core strength of about 50 psi, as measured by a Dietert core hardness tester, is reached. The core or mold is then removed and is allowed to further harden under ambient conditions for several hours or more or overnight.

The linear polyphosphates useful in the practice of this invention include potassium, ammonium and zinc polyphosphates. The potassium polyphosphate is preferred. Ammonium polyphosphate is commercially available in the form of a fine powder, e.g. from Monsanto Chemical Company, and the usual commercial material is suitable for the practice of this invention. Potassium polyphosphate can be readily prepared by heating potassium dihydrogen phosphate at about 500° C. for 1–3 hours. Zinc polyphosphate is prepared similarly.

The source of polyvalent cations is preferably an alkaline earth material containing both an alkaline earth metal and an oxide. Such material is described, for example, in U.S. Pat. No. 3,923,525 which is incorporated herein by reference thereto.

Included among the suitable hardening materials are calcium oxides, magnesium oxides, calcium silicates, calcium aluminates, calcium aluminum silicates, magnesium silicates, and maqnesium aluminates. The preferred hardener is magnesium oxide, or a mixture consisting primarily of magnesium oxide. Also included among the suitable materials of the present invention are the zirconates, borates, and titanates of the alkaline earth metals.

Another source of polyvalent cations is wet process phosphoric acid obtained by the acidification of phosphate rock. Two grades which occur in the process are known in the art as black acid and green acid. Either one can be used as the source of polyvalent cations.

It is preferred to employ either a free alkaline earth metal oxide or a mixture of an alkaline earth metal oxide and a material which contains the alkaline earth metal oxide in combination with another constituent such as calcium aluminates. In addition, the preferred alkaline earth metal oxides are the magnesium oxides.

Those materials which include components in combination with the oxide or hydroxide, and the alkaline earth metal, in some instances can be considered as being a latent source of the alkaline earth metal oxide for introducing the alkaline earth metal oxide into the binder system.

A particularly preferred source of polyvalent ions is provided by a commercially available product, Inoset H, marketed by Ashland Chemical Company, Columbus, Ohio. It is believed to consist largely of magnesium oxide with about 9% of aluminum oxide and about 5% of calcium oxide.

The orthophosphoric acid used in the practice of this invention is preferably the 85% grade, although less concentrated acid can be used. Phosphoric acid prepared by wet process is preferred to that obtained by oxidation of elemental phosphorous. Wet process acid useful in the practice of this invention is preferably the so-called black acid, but green acid is also a useful acid. When black or green acid is used as the phosphoric acid component, it simultaneously serves as the polyvalent metal ion source.

The foundry aggregate useful in the practice of this invention can be any known aggregate such as silica sand, zircon, olivine, alumino silicate sand (zeolite), chromite, sand and the like. Olivine is a preferred sand. The aggregate should be of a particle size consistent with desired result.

Olivine sand is preferred for use with the improved binder of this invention. It is a natural mineral consisting of a solid solution rich in magnesium orthosilicate (Fosterite) with a minor amount of ferric orthosilicate (Fayalite). Olivine is a major component of dunite rock. Peridotite is another olivine-bearing rock. Typically, olivine has a composition falling within the following general ranges:

MgO: 40–52% by weiqht
$SiO_2$: 35–45% by weight
FeO: 6.5–10% by weight
$Al_2O_3$, $K_2O$, $Na_2O$: Trace Any olivine falling within the above ranges is suitable for the practice of this invention.

The invention will be better understood with reference to the following examples. It is understood that these examples are intended only to illustrate the invention and it is not intended that the invention be limited thereby.

EXAMPLE 1

Ammonium polyphosphate (APP) 6.0 g (fine grade Phos Chek obtained from Monsanto Chemical Company, St. Louis, MO.) was applied to 500 g olivine sand by mixing in a Hobart N-50 mixer for several minutes to provide 1.2% on the sand. Phosphoric acid, 10 g, was then added with mixing followed by 10 g of a dry commercial powdered hardener (Inoset H obtained from Ashland Chemical Company, Columbus, Ohio). These amounts provided 2% of each based on the weiqht of the olivine. The mixture was then quickly packed into a "dog bone" mold where it was permitted to cure until a compressive strength of 50+ psi was obtained, as measured by the Dietert 454 B tester. It was then stripped from the mold and left to stand overnight. The tensile strength was 72 psi.

EXAMPLE 2

The experiment of Example 1 was repeated in all essential details except that a solution of lithium sulfate 10% by weight was substituted for hydrogen peroxide. It was allowed to cure for two hours at which time the compressive strength was 30+ psi. After standing overnight, the tensile strength was 102 psi.

EXAMPLE 3

The experiment of Example 1 was repeated in all essential details except that water was substituted for hydrogen peroxide and the hardener (Inoset H) was eliminated. It was allowed to cure for two hours at which time the compressive strength was 7 psi. After standing overnight the tensile strength was 40 psi.

EXAMPLE 4

The experiment of Example 1 was repeated in all essential details except that potassium polyphosphate prepared in the laboratory was substituted for ammonium polyphosphate. The mold was allowed to cure for one hour at which time the compressive strength was 50+ psi. The overnight tensile strength was 30 psi.

EXAMPLE 5

The experiment of Example 4 was repeated in all essential details except that the hardener (Inoset H) was eliminated. After curing one hour the compressive strength was 5 psi and the overnight tensile strength was 70 psi.

EXAMPLE 6

The experiment of Example 2 was repeated in all essential details except that potassium polyphosphate and a hardener consistinq of 4 parts magnesium oxide and 1 part calcium aluminate were substituted for Inoset H and ammonium polyphosphate. The compressive strength after one hour was 27 psi and the overnight tensile strength was 25 psi.

EXAMPLE 7

The experiment of Example 6 was repeated in all essential details except that 1.5% of Inoset H (based on sand) was used as the hardener. The compressive strength at one hour was 50+p psi. The overnight tensile strength was 42 psi.

EXAMPLE 8

The experiment of Example 1 is repeated in all essential details except that zinc polyphosphate is substituted for the ammonium compound. The overnight tensile strength is satisfactory.

We claim:

1. A composition adapted for preparing foundry cores and molds consisting of a foundry aggregate 1 to 10% by weight of the aggregate, a binder therefor and 1 to 10% by weight of the aggregate of a hardener, wherein the aggregate is selected from the group consisting of silica sand, olivine, zircon sand, alumino-silica sand and chromite sand, the binder is a linear zinc, potassium or ammonium polyphosphate and the hardner is selected from the group consisting of orthophosphoric acid or a polyvalent metal compound selected from the group consisting of calcium oxide, magnesium oxide, calcium silicate, magnesium silicate and magnesium aluminate or mixtures thereof.

2. The composition of claim 1 wherein the binder is potassium polyphosphate.

3. The composition of claim 1 wherein the binder is ammonium polyphosphate.

4. The composition of claim 1 wherein the binder is zinc polyphosphate.

5. The composition of claim 1 wherein the hardener is provided by black or green wet process phosphoric acid.

6. The composition of claim 1 wherein the aggregate is silica sand or olivine sand.

7. The composition of claim 1 wherein the binder and the phosphoric acid are present in a ratio of about 1:1 by weight.

8. The composition of claim 1 wherein the hardener is a mixture of a polyvalent metal compound and phosphoric acid.

9. The composition of claim 1 wherein the binder, the polyvalent metal compound and the orthophosphoric acid are present in a ratio of about 1:1:1 by weight.

10. A core or mold consisting essentially of a foundry aggregate, a binder and a hardener composition of claim 1.

* * * * *

UNITED STATES PATENT AND TRADEMARK OFFICE

CERTIFICATE OF CORRECTION

PATENT NO. :4,522,651

DATED :June 11, 1985

INVENTOR(S) :Charles E. Seeney et al

It is certified that error appears in the above-identified patent and that said Letters Patent are hereby corrected as shown below:

Column 2, line 32, "maqnesium" should read -- magnesium --

Column 3, line 39, "weiqht" should read -- weiqht --

Column 4, line 24, "50 + p psi" should read -- 50 + psi --

Signed and Sealed this

*Twenty-ninth* Day of *April 1986*

[SEAL]

*Attest:*

DONALD J. QUIGG

*Attesting Officer*

*Commissioner of Patents and Trademarks*